US008242672B2

(12) United States Patent
Kuribayashi et al.

(10) Patent No.: US 8,242,672 B2
(45) Date of Patent: Aug. 14, 2012

(54) SPARK PLUG HAVING A FIXATION ASSISTING MEMBER FOR THE INSULATOR

(75) Inventors: Makoto Kuribayashi, Aichi (JP); Toshitaka Honda, Aichi (JP); Keita Nakagawa, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 12/736,630

(22) PCT Filed: Apr. 24, 2009

(86) PCT No.: PCT/JP2009/001892

§ 371 (c)(1),
(2), (4) Date: Oct. 25, 2010

(87) PCT Pub. No.: WO2009/133683

PCT Pub. Date: Nov. 5, 2009

(65) Prior Publication Data

US 2011/0037371 A1 Feb. 17, 2011

(30) Foreign Application Priority Data

Apr. 28, 2008 (JP) ..... 2008-116992

(51) Int. Cl.
*H01T 13/05* (2006.01)

(52) U.S. Cl. ..... 313/134; 313/133; 313/135

(58) Field of Classification Search ..... 313/118–145, 313/238; 123/143 R, 146.5 R, 169 R, 169 EL, 123/169 P, 260, 280; 29/33 M, 33 N, 842, 29/844, 847, 888.01

See application file for complete search history.

(56) References Cited

U.S. PATENT DOCUMENTS

| | | | | |
|---|---|---|---|---|
| 4,568,855 | A * | 2/1986 | Nemeth et al. | 315/59 |
| 4,658,185 | A | 4/1987 | Albrecht et al. | 315/58 |
| 5,095,242 | A | 3/1992 | Richeson | 313/143 |
| 5,785,035 | A | 7/1998 | Mitani et al. | 123/633 |
| 5,975,926 | A | 11/1999 | Uchiyama et al. | 439/126 |
| 6,111,345 | A | 8/2000 | Shibata et al. | 313/141 |
| 6,160,342 | A * | 12/2000 | Nishikawa et al. | 313/141 |
| 6,334,800 | B1 * | 1/2002 | Nishikawa et al. | 445/7 |
| 6,559,578 | B1 | 5/2003 | Herden et al. | 313/136 |
| 6,566,792 | B2 | 5/2003 | Nishikawa | 313/118 |
| 2002/0041138 | A1 * | 4/2002 | Nishikawa | 313/143 |

FOREIGN PATENT DOCUMENTS

| | | |
|---|---|---|
| JP | 61-135079 A | 6/1986 |
| JP | 10302929 | 11/1998 |
| JP | 10-321343 A | 12/1998 |
| JP | 2005-129398 A | 5/2005 |
| JP | 2005-129399 A | 5/2005 |

OTHER PUBLICATIONS

Form PCT/ISA/210—Int'l Search Report (from corresponding Int'l Patent App. No. PCT/JP2009/001892—English version only); 2 pages.

* cited by examiner

*Primary Examiner* — Tracie Y Green
(74) *Attorney, Agent, or Firm* — Kusner & Jaffe

(57) ABSTRACT

The present invention provides a technique of suppressing the generation of radio noise in a spark plug, wherein a high dielectric constant fixation-assisting member, formed of a high dielectric constant material which is higher in dielectric constant than alumina, is provided between a metallic shell and a second conductive portion CP2 which includes a metallic terminal of the spark plug 100.

10 Claims, 6 Drawing Sheets

SECOND EMBODIMENT

THIRD EMBODIMENT

FIG. 6

FOURTH EMBODIMENT

| | Portion where high dielectric constant material is used | Cu (pF) | Cg (pF) | Cr (pF) | rg (Ω) | Rr (kΩ) | Attenuation at 500 MHz (dB) | Effect ratio to Comp. Example 1 | Effect ratio to Comp. Example 2 | Evaluation |
|---|---|---|---|---|---|---|---|---|---|---|
| Comp. Example 1 | None | 10.1 | 6.0 | 0.7 | 30 | 5.0 | 30.1 | 1.0 | 1.1 | Poor |
| Comp. Example 2 | None | 14.5 | 2.9 | 1.4 | 20 | 1.5 | 27.6 | 0.9 | 1.0 | Poor |
| Example 1 | Fixation assisting member | 18.0 | 6.0 | 0.7 | 30 | 5.0 | 35.1 | 1.2 | 1.3 | Good |
| Example 2 | Coating layer | 18.0 | 6.0 | 0.7 | 30 | 5.0 | 35.1 | 1.2 | 1.3 | Good |
| Example 3 | Both | 36.0 | 6.0 | 0.7 | 30 | 5.0 | 41.1 | 1.4 | 1.5 | Excellent |
| Example 4 | Fixation assisting member | 29.0 | 2.9 | 1.4 | 20 | 1.5 | 33.6 | 1.1 | 1.2 | Good |
| Example 5 | Coating layer | 29.0 | 2.9 | 1.4 | 20 | 1.5 | 33.6 | 1.1 | 1.2 | Good |
| Example 6 | Both | 58.0 | 2.9 | 1.4 | 20 | 1.5 | 39.6 | 1.3 | 1.4 | Excellent |

SPARK PLUG HAVING A FIXATION ASSISTING MEMBER FOR THE INSULATOR

FIELD OF THE INVENTION

The present invention relates to a spark plug.

BACKGROUND OF THE INVENTION

A spark plug includes a ground electrode and a center electrode disposed to face each other with a gap (clearance) therebetween, and generates spark discharge upon application of high voltage between the two electrodes. However, it is known that, since spark discharge causes an instantaneous change in current, radio noise is generated at the time of ignition by the spark plug. If this radio noise becomes severe, the noise not only affects electronic devices, such as an ECU (Engine Control Unit), of a vehicle or the like onto which the spark plug is mounted, but may also exert electromagnetic interference on the surroundings. Heretofore, various techniques have been proposed in order to reduce such radio noise. (See, for example, Japanese Patent Application Laid-Open (kokai) No. S61-135079).

However, since radio noise generated in a spark plug includes radio waves in a wide frequency range from a low frequency to a high frequency, in actuality, conventional techniques, including the above-mentioned prior art technique, cannot reduce the radio noise sufficiently.

SUMMARY OF THE INVENTION

An advantage of the present invention is a technique for suppressing the generation of radio noise in a spark plug.

The present invention has been accomplished in order to at least partially solve the above-described problem, and can be realized in the following modes or application examples.

In accordance with one aspect of the present invention, there is provided a spark plug comprising:

a center electrode, a terminal portion electrically connected to the center electrode so as to apply a voltage from an external power source to the center electrode;

a ground electrode disposed on a front end side such that a gap for spark discharge is formed between the ground electrode and the center electrode; and a metallic shell which holds the ground electrode, which is electrically connected to the ground electrode, and in which the center electrode is disposed, wherein a high dielectric constant material which is higher in dielectric constant than alumina is disposed between the terminal portion and the metallic shell.

In general, the capacitance between the terminal portion and the metallic shell serves as a capacitor which attenuates the voltage of discharge current flowing toward the terminal portion. In the above-described structure, since the capacitance of this capacitor is increased by the high dielectric constant material, the degree of attenuation of the discharge current can be increased. Accordingly, the generation of radio noise in the spark plug can be suppressed.

In accordance with a second aspect of the present invention, there is provided a spark plug as described above, further comprising an insulator which is held within the metallic shell and in which the center electrode and the terminal portion are held, wherein the high dielectric constant material is disposed between the insulator and the metallic shell.

According to this spark plug, the high dielectric constant material disposed between the insulator and the metallic shell can suppress the generation of radio noise in the spark plug.

In accordance with a third aspect of the present invention, there is provided a spark plug as described above, wherein the insulator includes a collar portion which is located at an approximate center with respect to a longitudinal direction thereof and has an outer diameter greater than that of the remaining portion, and a fixation assisting member is provided on the rear end side of the collar portion in order to assist a function of the metallic shell of holding the insulator; and the fixation assisting member includes at least the high dielectric constant material.

Conventionally, in a spark plug, talc powder is used as a fixation assisting member. A powder material which is higher in dielectric constant than alumina can be used to be mixed in the talc powder or replace the talc powder. By virtue of this configuration, the bonding between the insulator and the metallic shell can be maintained, and the generation of radio noise in the spark plug can be suppressed.

In accordance with a fourth aspect of the present invention, there is provided a spark plug as described above, wherein the high dielectric constant material is applied to an outer surface of the insulator as a coating layer.

Conventionally, in a spark plug, a glaze is applied to cover the outer surface of the insulator in order to increase the strength of the insulator. A material which is higher in dielectric constant than alumina can be mixed into the glaze or can be used to replace the glaze so as to form a coating layer on the outer surface of the insulator. By virtue of this configuration, the strength of the insulator can be maintained, and the generation of radio noise in the spark plug can be suppressed. Notably, the coating layer is not necessarily required to be provided on the outermost surface of the insulator, and another coating layer may be formed on the outer side of the former coating layer.

In accordance with a fifth aspect of the present invention, there is provided a spark plug as described above, wherein the high dielectric constant material contains an ABO3-type perovskite oxide (A site is at least one of Ca, Sr, Ba, Pb, and La; and B site is at least one of Zr, Ti, Ce, and Al).

In accordance with a sixth aspect of the present invention, there is provided a spark plug as described above, wherein the high dielectric constant material contains an oxide of zirconium (Zr) or hafnium (Hf).

In accordance with a seventh aspect of the present invention, there is provided a spark plug comprising:

a center electrode, a terminal portion electrically connected to the center electrode so as to apply a voltage from an external power source to the center electrode;

a ground electrode disposed on a front end side such that a gap for spark discharge is formed between the ground electrode and the center electrode; and a metallic shell which holds the ground electrode, which is electrically connected to the ground electrode, and in which the center electrode is disposed, wherein a capacitance between the terminal portion and the metallic shell is 16.0 pF or greater.

In general, the capacitance between the terminal portion and the metallic shell serves as a capacitor which attenuates the voltage of discharge current flowing toward the terminal portion. In the above-described structure, since the capacitance of this capacitor is 16.0 pF or greater, the degree of attenuation of the discharge current can be increased. Accordingly, the generation of radio noise in the spark plug can be suppressed.

In accordance with an eighth aspect of the present invention, there is provided a spark plug as described with respect to the seventh aspect, wherein the capacitance is 18.0 pF or greater.

According to this spark plug, since the capacitance between the terminal portion and the metallic shell is increased further, the generation of radio noise can be suppressed to a greater extent.

In accordance with a ninth aspect of the present invention, there is provided a spark plug according to the seventh and eighth aspect of the present invention, wherein the capacitance is 29.0 pF or greater.

According to this spark plug, since the capacitance between the terminal portion and the metallic shell is increased further, the generation of radio noise can be suppressed to a greater extent.

In accordance with a tenth aspect of the present invention, there is provided a spark plug according to the seventh, eighth and ninth aspects of the present invention, wherein the capacitance is 36.0 pF or greater.

According to this spark plug, since the capacitance between the terminal portion and the metallic shell is increased further, the generation of radio noise can be suppressed to a greater extent.

In accordance with an eleventh aspect of the present invention, there is provided a spark plug according to the seventh through tenth aspects of the present invention, wherein the capacitance is 58.0 pF or less.

According to this spark plug, the generation of radio noise can be suppressed effectively.

In accordance with a twelfth aspect of the present invention, there is provided a spark plug according to the seventh through eleventh aspects of the present invention, wherein the capacitance is increased by a member which is disposed between the terminal portion and the metallic shell and which is higher in dielectric constant than alumina.

According to this spark plug, the capacitance between the terminal portion and the metallic shell can be increased by increasing the dielectric constant of the member disposed between the terminal portion and the metallic shell. Accordingly, the generation of radio noise in the spark plug can be suppressed.

Notably, the present invention can be realized in various forms; for example, the invention can be realized in the form of a spark plug, in the form of an internal combustion engine onto which the spark plug is mounted, or in the form of a vehicle onto which the internal combustion engine is mounted.

BRIEF DESCRIPTION OF THE DRAWINGS

FIG. 6 is an explanatory table showing radio noise suppression effects of spark plugs according to a fourth embodiment.

DETAILED DESCRIPTION OF PREFERRED EMBODIMENTS

Next, embodiments of the present invention will be described in the following sequence.

Figure 1:
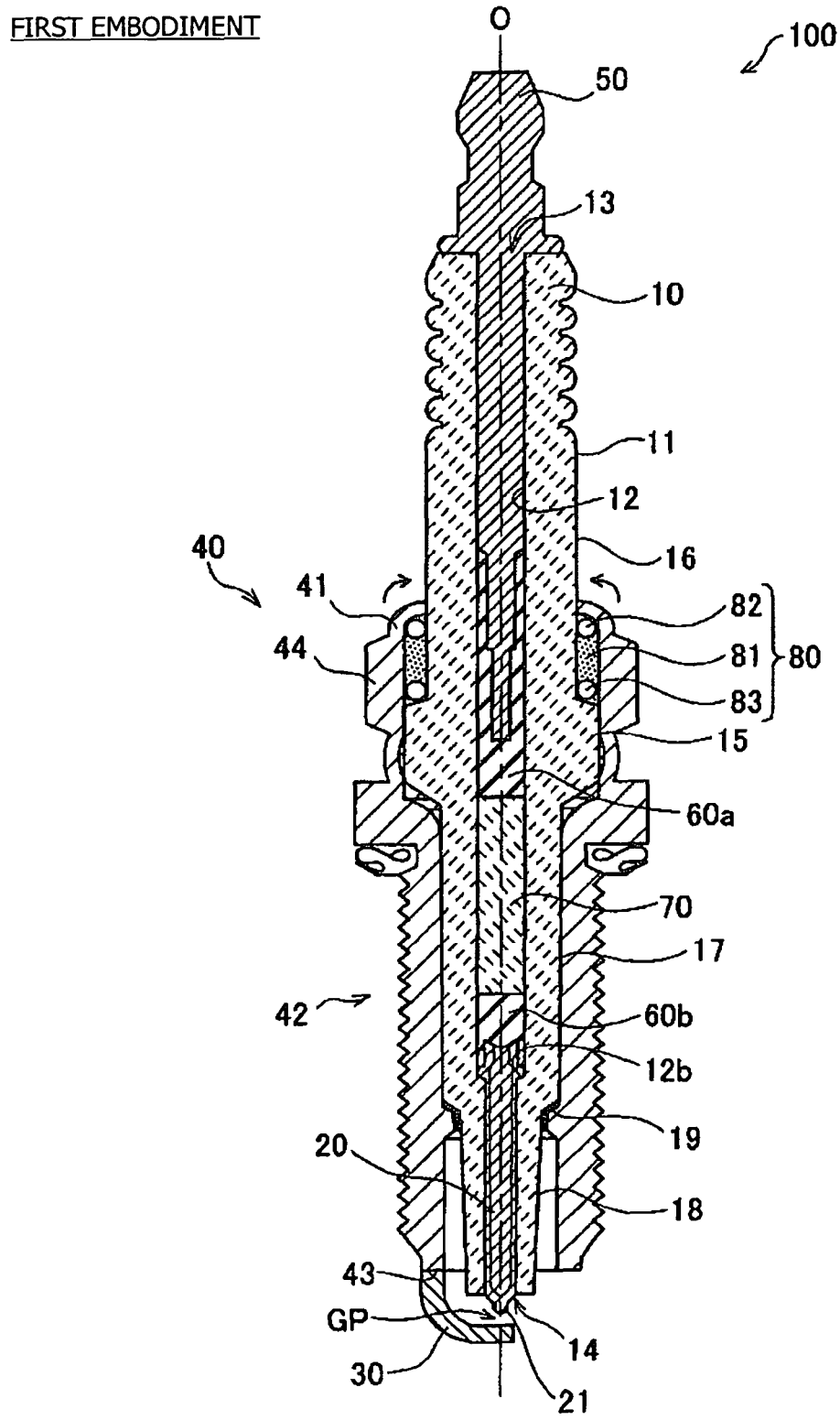
FIG. 1 is a schematic cross-sectional view showing the structure of a spark plug according to a first embodiment.

A. First Embodiment:

B. Second Embodiment:

C. Third Embodiment:

D. Fourth Embodiment:

E. Modifications:

A. First Embodiment:

FIG. 1 is a schematic diagram showing the structure of a spark plug according to one embodiment of the present invention. The spark plug 100 includes an insulator 10, a center electrode 20, a ground electrode 30, a metallic shell 40, and a metallic terminal 50. This spark plug 100 is attached to a combustion chamber of an internal combustion engine, and generates spark discharge between two electrodes (the center electrode 20 and the ground electrode 30) disposed to form a gap GP therebetween.

The insulator 10 is an insulating member which constitutes a body portion of the spark plug 100 for holding the two electrodes 20 and 30. For example, the insulator 10 is formed by firing insulating ceramic such as alumina ($Al_2O_3$). The insulator 10 assumes a tubular shape, and includes an axial hole 12 extending along the direction of an axis O shown in FIG. 1. The insulator 10 has a collar portion 15 which is formed at an approximate center thereof with respect to the direction of the axis O and at which the insulator 10 has the maximum outer diameter. Notably, the outer surface of the insulator 10 is covered by a glaze layer 11 formed through application of glaze. The glaze layer 11 increases the strength of the insulator 10.

On the rear end side of the insulator 10, a metallic terminal 50, which is electrically connected to an external power source, is inserted into an opening portion 13 of the axial hole 12, and is fixedly held therein. This metallic terminal 50 corresponds to the "terminal portion" of the present invention. Further, on the side of the insulator opposite the side where the metallic terminal 50 is disposed, a center electrode 20 is inserted into an opening portion 14 of the axial hole 12, and is fixedly held therein. Two seal portions 60*a* and 60*b*, and a resistor 70 are provided within the axial hole 12 between the center electrode 20 and the metallic terminal 50. In the following description, the side where the center electrode 20 is disposed will be referred to as the "front end side."

The first seal portion 60*a* is provided between the metallic terminal 50 and the resistor 70, and the second seal portion 60*b* is provided between the resistor 70 and the center electrode 20. The two seal portions 60*a* and 60*b* fix the metallic terminal 50 and the center electrode 20 to the wall surface of the axial hole 12, establish electrical continuity therebetween, and secure airtightness within the axial hole 12. The seal portions 60*a* and 60*b* are formed of a glass material having electrical conductivity. The function of the resistor 70 will be described later. Notably, the resistor 70 desirably has a resistance (for example, about 5 kΩ) which does not affect the igniting performance of the spark plug 100.

A portion of the insulator 10 which extends from the collar portion 15 toward the opening portion 13, into which the metallic terminal 50 is inserted, will be referred to as a "terminal-side tube portion 16". Further, the insulator 10 has a step 19 provided on a portion extending from the collar portion 15 toward the center electrode 20, whereby two portions having different diameters are formed. Hereinafter, a larger diameter portion extending from the collar portion 15 to the step 19 will be referred to as an "electrode-side tube portion 17," and a smaller diameter portion extending from the step 19 to the opening portion 14, into which the center electrode 20 is inserted, will be referred to as a "front-end tube portion 18."

A metallic shell 40, which is an approximately cylindrical metallic member, is disposed around the insulator 10. More specifically, the metallic shell 40 accommodates a portion of the terminal-side tube portion 16, the collar portion 15, the electrode-side tube portion 17, the step 19, and a portion of the front-end tube portion 18 of the insulator 10, and holds the insulator 10 by means of crimping (the crimping will be described later). A ground electrode 30 is provided at a front end portion 43 of the metallic shell 40, which is a portion thereof located on the front end side. The ground electrode 30 is bent into an approximately L-like shape. One end of the ground electrode 30 is welded to the metallic shell 40, and the other end thereof faces a front end portion 21 of the center electrode 20 via a gap GP (hereinafter referred to as the "spark gap GP").

The metallic shell 40 has a crimp portion 41, whose wall thickness is rendered relative small in order to facilitate crimping work, which is a process for holding the insulator 10. The crimp portion 41 is provided at the rear end of the metallic shell 40, and is bent inward in order to urge the collar portion 15 toward the front end via a fixation assisting portion 80, which will be described later. Meanwhile, on the front end side of the metallic shell 40, a step 12*b* is formed on the inner circumference of the metallic shell 40 by means of reducing the diameter of the axial hole 12. The step 12*b* receives the step 19 of the insulator 10 to thereby establish an airtight state. In order to improve the airtightness, a plate packing may be interposed between the step 12*b* and the step 19 as well known.

Notably, a tool engagement portion 44, dimensioned to engage a spark plug wrench, is provided on the front end side of the crimp portion 41. Further, the metallic shell 40 has a screw portion 42, which is used to fix the spark plug 100 to a mount portion of an internal combustion engine through screw engagement.

The fixation assisting portion 80 is provided between the crimp portion 41 and the collar portion 15 in order to assist fixing between the insulator 10 and the metallic shell 40. Specifically, at the rear end of the metallic shell 40, a space is formed between the inner circumferential surface of the metallic shell 40 and the outer surface of the insulator 10. A high dielectric constant fixation assisting member 81 and two wire packings 82 and 83 are disposed in the space. Thus, the fixation assisting portion 80 is formed. More specifically, the high dielectric constant fixation assisting member 81, which is a ring-shaped powder compact formed through pressing of powder, is disposed between the two wire packings 82 and 83, which surround the outer circumference of the insulator 10.

The fixation assisting portion 80 functions as a cushioning material for absorbing differences in thermal expansion among the constituent members of the spark plug 100 and impact forces acting on the insulator 10. The fixation assisting portion 80 also has a function of improving the airtightness between the insulator 10 and the metallic shell 40. The high dielectric constant fixation assisting member 81 is formed of a high dielectric constant material which is higher in dielectric constant (relative dielectric constant) than $Al_2O_3$, which is the main component of the insulator 10. By way of example and not limitation, the high dielectric constant fixation assisting member 81 can be formed of barium titanate ($BaTiO_3$). Notably, the dielectric constant of $Al_2O_3$ is about 8 to 11, and the dielectric constant of $BaTiO_3$ is about 100 to 1000, although it changes with temperature. The reason why the high dielectric constant fixation assisting member 81 is formed of a material whose dielectric constant is higher than that of $Al_2O_3$ will be described later.

Figure 2:
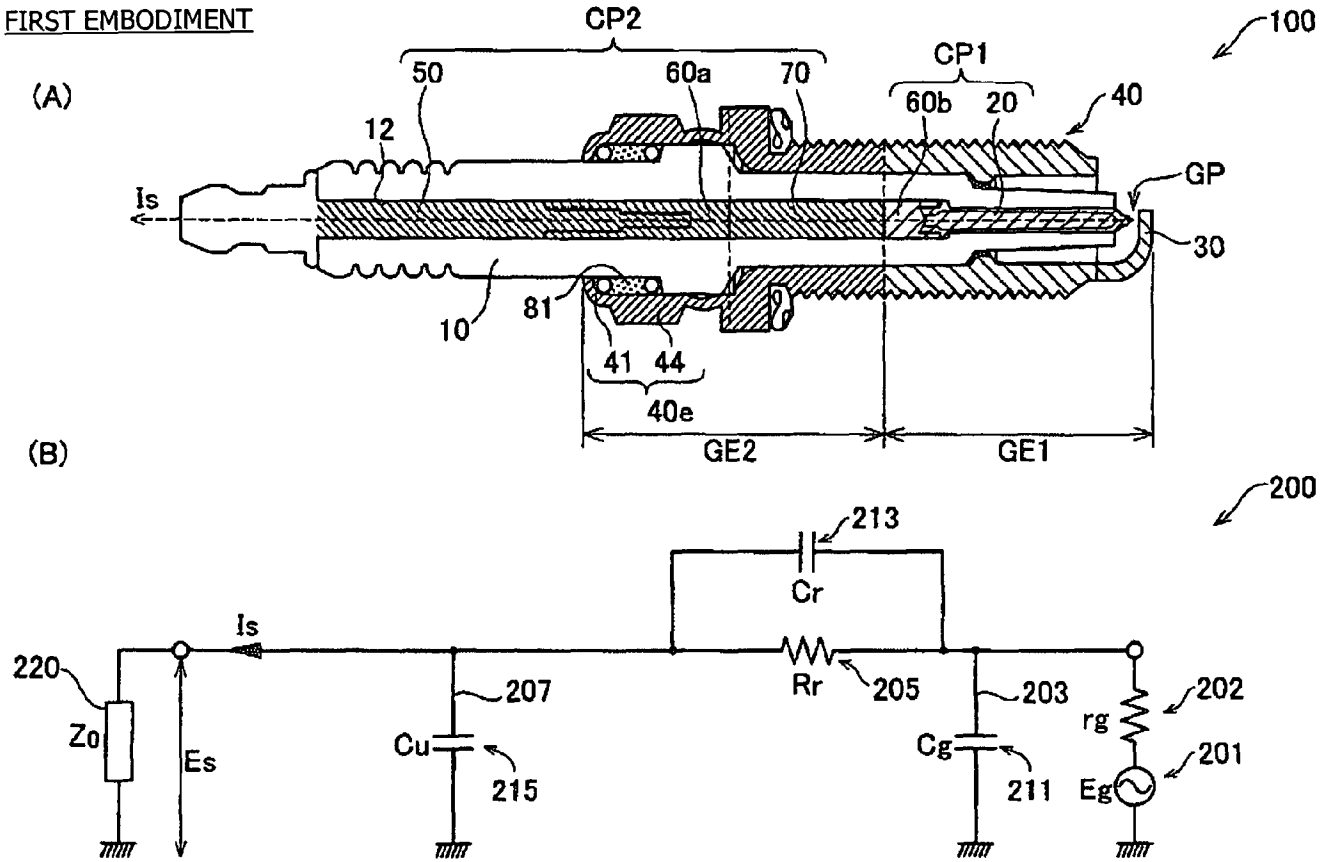
FIG. 2 is a schematic cross-sectional view of the spark plug according to the first embodiment, and circuit diagram showing its equivalent circuit.

FIGS. 2(A) and 2(B) are an explanatory view and an explanatory diagram, respectively, used for explaining a mechanism by which radio noise is suppressed in the spark plug 100. FIG. 2(A) is a schematic cross-sectional view showing the structure of the spark plug 100. FIG. 2(A) is identical with FIG. 1, except that cross-hatching and symbols are changed in order to facilitate description and understanding. Here, there is assumed a case where spark discharge is generated at the spark gap GP. At that time, a discharge current Is flows to the outside of the spark plug 100 via the center electrode 20, the second seal portion 60*b*, the resistor 70, the first seal portion 60*a*, and the metallic terminal 50, in this sequence.

Here, a cross-hatched area which includes the center electrode 20 and the second seal portion 60*b* and which extends to the resistor 70 will be referred to as a "first conductive portion CP1." Further, a cross-hatched area which includes the first seal portion 60*a* and which extends from the resistor 70 to a portion of the metallic terminal 50 inserted into the axial hole 12 of the insulator 10 will be referred to as a "second conductive portion CP2." Meanwhile, a cross-hatched area which includes the ground electrode 30 and a portion of the metallic shell 40 which faces the first conductive portion CP1 via a portion of the insulator 10 will be referred to as a "first ground electrode GE1" Further, a portion of the metallic shell 40 which extends from the first ground electrode GE1 toward the metallic terminal 50 side will be referred to as a "second ground electrode GE2."

The first conductive portion CP1 and the first ground electrode GE1 can be considered to constitute a capacitor by sandwiching a portion of the insulator 10, which is a dielectric material. Similarly, the second conductive portion CP2 and the second ground electrode GE2 can be considered to constitute a capacitor; and the first and second seal portions 60*a* and 60*b* can be considered to constitute a capacitor by sandwiching the resistor 70. Therefore, when the spark plug 100 generates radio noise, it can be considered to form an electric circuit as described below.

FIG. 2(B) is a circuit diagram showing an equivalent circuit 200 of the spark plug 100 at the time when it generates radio noise. An AC power source 201 corresponds to the spark gap GP, which is generating spark discharge. Accordingly, an input voltage Eg provided from the AC power source 201 is equal to a discharge voltage of the spark plug 100. A first resistor 202 corresponds to a resistor at the spark gap GP through which the discharge current Is flows (hereinafter referred to as a "discharge resistor"). Notably, the resistance of the first resistor 202 is represented by rg. A second resistor 205 connected in series to the first resistor 202 corresponds to the resistor 70 of the spark plug 100. The resistance of the second resistor 205 is represented by Rr.

A first capacitor 211 is provided in a first ground path 203 which extends from a line between the first and second resistors 202 and 205, and is connected to the ground. The first capacitor 211 corresponds to a capacitor formed by the above-described first conductive portion CP1 and first ground electrode GE1. The capacitance of the first capacitor 211 is represented by Cg.

In the equivalent circuit 200, a second capacitor 213 is connected in parallel to the second resistor 205. The second capacitor 213 corresponds to a capacitor formed by the above-described first and second seal portions 60*a* and 60*b*. The capacitance of the second capacitor 213 is represented by Cr.

In the equivalent circuit 200, a second ground path 207 extends from a line located the output side of the second resistor 205, and is connected to the ground. A third capacitor 215 is provided in the second ground path 207. The third capacitor 215 corresponds to a capacitor formed by the above-described second conductive portion CP2 and second ground electrode GE2. The capacitance of the third capacitor 215 is represented by Cu.

A voltage ratio A, which the ratio between the input voltage Eq and the output voltage Es in the equivalent circuit 200, can be obtained from the above-described resistances rg, Rr and capacitances Cg, Cr, Cu in accordance with the following Equation (1). Further, the voltage attenuation S in the equivalent circuit 200 can be obtained from the voltage ratio A in accordance with the following Equation (2).

$$A = \left(\frac{Eg}{Es}\right)_{Is=0} = j\cdot\omega\cdot Cg\cdot rg + \frac{1 + j\cdot\omega\cdot Cu\cdot Z_0}{Z_0(1 + j\cdot\omega\cdot Cr\cdot Z_0)} \times \{Rr + rg + j\cdot\omega\cdot Rr\cdot rg(Cr + Cg)\} \quad \text{Equation (1)}$$

$$S = 20\log|A| \quad \text{Equation (2)}$$

In Equation (1), the coefficient $Z_0$ represents the characteristic impedance of an external cable 220 connected to the output side of the equivalent circuit 200.

The greater the attenuation S of Equation (2), the greater the degree to which radio noise is reduced in the spark plug 100. The inventors of the present invention found that the attenuation S can be increased by increasing the value of the capacitance Cu in Equation (1). The capacitance Cu can be increased by increasing the dielectric constant between the second conductive portion CP2 and the second ground electrode GE2 shown in FIG. 2(A). In particular, the capacitance Cu can be increased efficiently by increasing the dielectric constant of the member disposed between the second conductive portion CP2 and an end portion (rear-end-side portion) 40*e* of the metallic shell 40 including the crimp portion 41 and the tool engagement portion 44. In the present embodiment, the high dielectric constant fixation assisting member 81, which is higher in dielectric constant than $Al_2O_3$ (the main component of the insulator 10), is provided between the second conductive portion CP2 and the second ground electrode GE2, whereby radio noise generated from the spark plug 100 is reduced.

Figure 3:
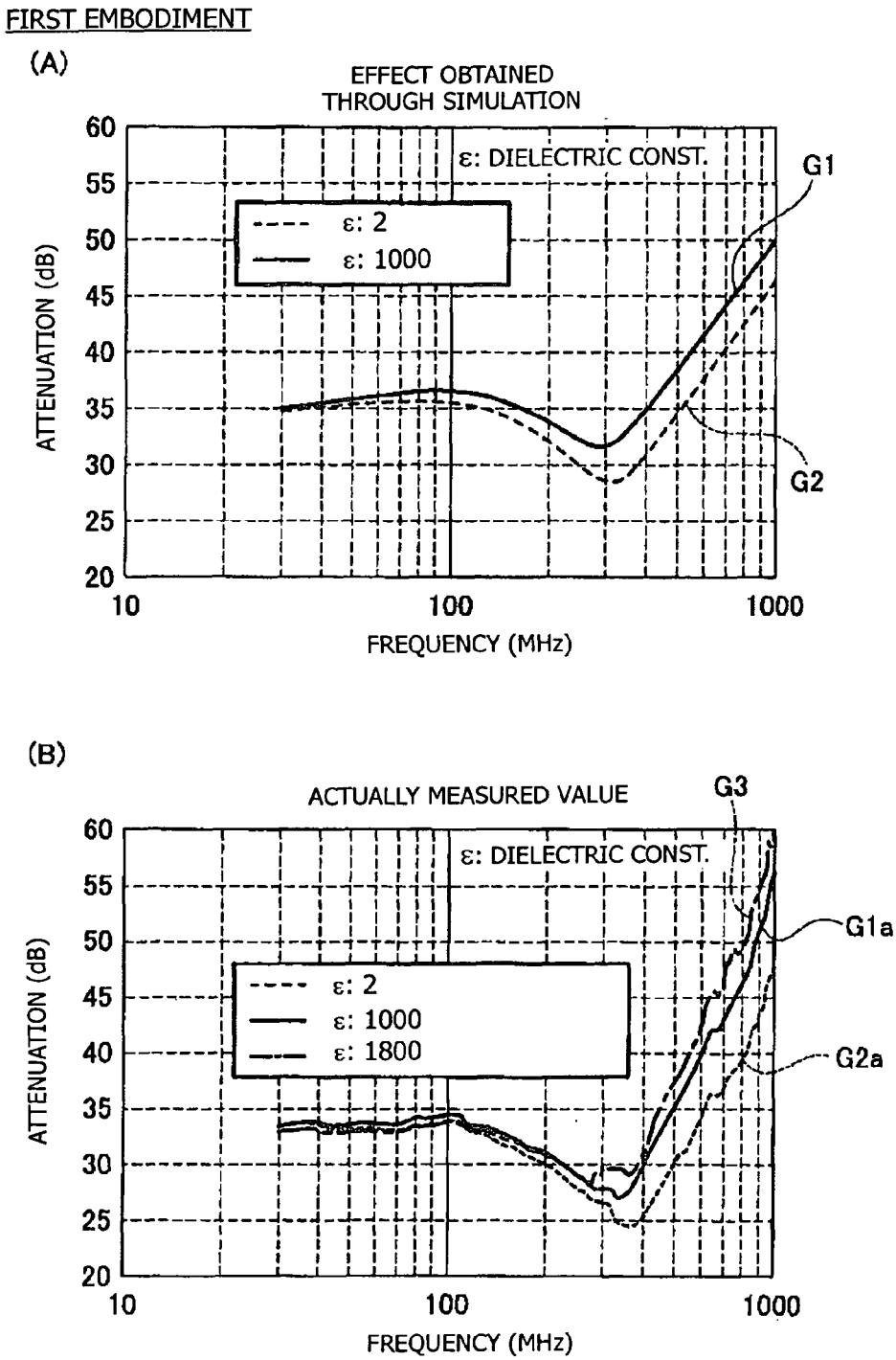
FIG. 3 is a graph showing an effect of suppressing radio noise by a fixation assisting member.

FIGS. 3(A) and 3(B) are graphs showing the radio noise suppression effect of the high dielectric constant fixation assisting member 81, in which change in attenuation with the frequency of radio noise is shown. FIG. 3(A) is a graph showing the result of simulation on attenuation of radio noise in a spark plug, which is obtained from the above-described Equations (1) and (2). Specifically, curve G1 shows the result of simulation which was performed, with the dielectric constant of the high dielectric constant fixation assisting member 81 set to 1000 for an assumed case where the high dielectric constant fixation assisting member 81 is formed of $BaTiO_3$. Curve G2 shows the result of simulation which was performed, with the dielectric constant of the high dielectric constant fixation assisting member 81 set to 2 for an assumed case where the high dielectric constant fixation assisting member 81 is formed of talc only (Comparative Example).

FIG. 3(B) is a graph showing actual values of attenuation of radio noise measured by the inventors of the present invention. A BOX method (JASO D002-2: 2004) was employed so as to measure the attenuation of radio noise. Curve G1*a* shows the attenuation of radio noise of a spark plug in which the high dielectric constant assisting member 81 is formed of $BaTiO_3$ (dielectric constant: 1000). Broken curve G2*a* shows the attenuation of radio noise of a spark plug in which the high dielectric constant assisting member 81 is formed of talc (dielectric constant: 2) only (Comparative Example). Moreover, single-dot curve G3 shows the attenuation of radio noise of a spark plug in which the high dielectric constant assisting member 81 is formed of $Ba_{0.9}Sr_{0.1}Ti_{0.85}Zr_{0.15}O_3$ (dielectric constant: 1800).

As shown in these graphs, in both the results of simulation and the actually measured values, the spark plug in which the high dielectric constant fixation assisting member 81 is formed of a material whose dielectric constant is higher than that of alumina is greater in attenuation than the spark plug of Comparative Example. Further, comparison between the curves G1*a* and G3 reveals that the higher the dielectric constant of the high dielectric constant fixation assisting member 81, the greater the attenuation attained thereby, and the greater the radio noise suppression effect.

In general, a spark plug includes a fixation assisting member which is formed through press forming of powder and which is provided at a position similar to that of the high dielectric constant fixation assisting member 81 of the spark plug 100 of the present embodiment. Below is described a method of measuring the dielectric constant of the fixation assisting member.

(i) The volume of the fixation assisting member is measured. Specifically, the volume of the fixation assisting member may be obtained by measuring the cross section of the fixation assisting member by use of a plurality of cross-sectional images of a spark plug obtained through radiography, and calculating the volume from the measured cross section. Alternatively, the volume of the fixation assisting member may be obtained by actually cutting the spark plug and the fixation assisting member.

(ii) The weight of the fixation assisting member is measured. Specifically, the weight of the fixation assisting member, which is removed from the spark plug through disassembly, may be measured.

(iii) The charging density of powder which constitutes the fixation assisting member is calculated from the results of the measurements in the above-described steps (i) and (ii).

(iv) A measurement sample for measuring dielectric constant is prepared. Specifically, a charging pressure is calculated from the charging density calculated in the above-described step (iii), and a separately prepared material powder having the same composition as the fixation assisting member is press-formed under that charging pressure, whereby the measurement sample is prepared. Notably, the material powder may be powder of the fixation assisting member collected by disassembling a plurality of spark plugs of the same type.

(v) The dielectric constant of the prepared measurement sample is measured by a parallel-conductor-plate-type dielectric resonator method based on JIS R1627 (1996).

This measurement method can determine the dielectric constant of the fixation assisting member.

As described above, radio noise of the spark plug 100 can be reduced by means of disposing between the second conductive portion CP2 and the metallic shell 40 a high dielectric constant material whose dielectric constant is higher than that of alumina.

Figure 4:
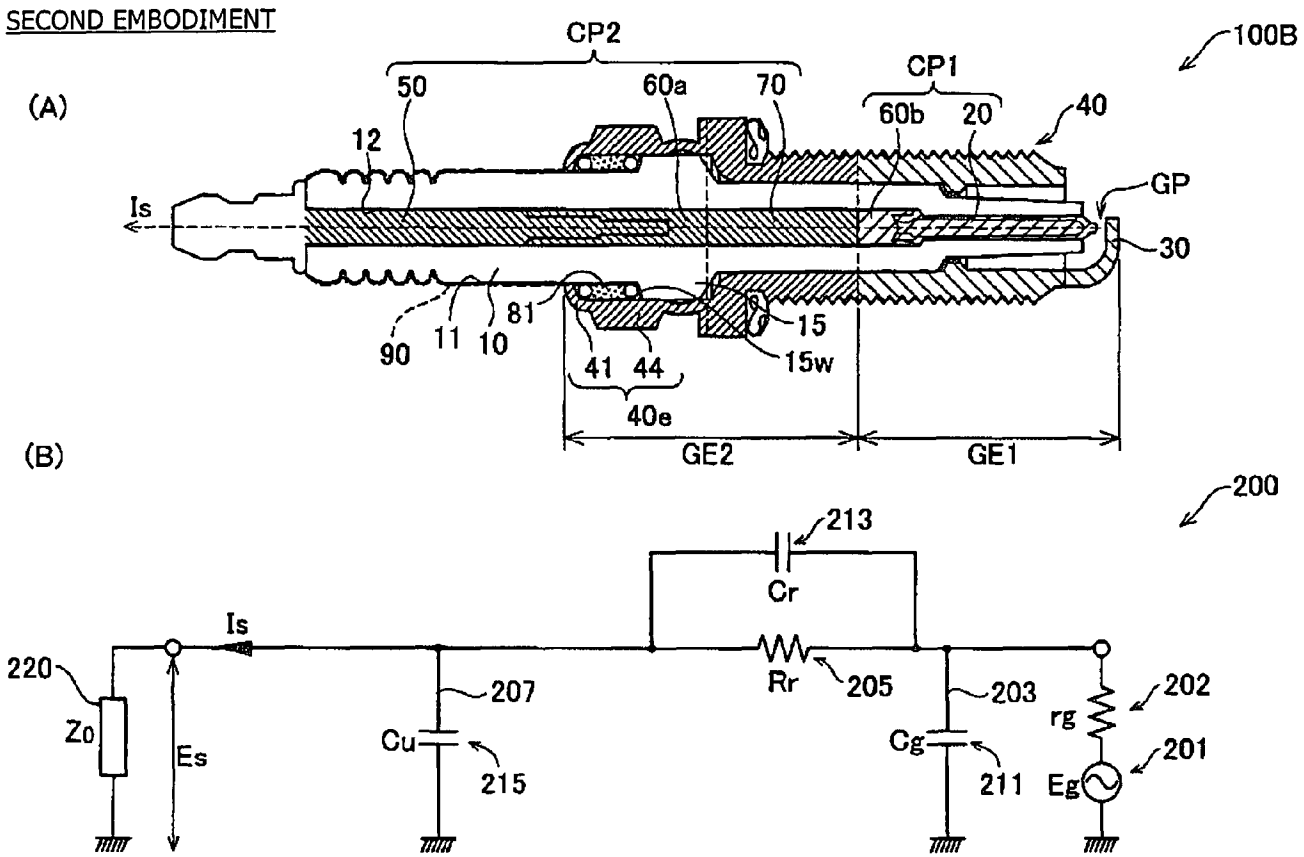
FIG. 4 is a schematic cross-sectional view of a spark plug according to a second embodiment, and circuit diagram showing its equivalent circuit.

B. Second Embodiment:

FIG. 4(A) is a schematic cross-sectional view showing the structure of a spark plug 100B according to a second embodiment of the present invention. FIG. 4(A) is generally the same as FIG. 2(A), except that a high dielectric constant coating layer 90 is provided on the outer surface of the insulator 10. FIG. 4(B) is a circuit diagram showing an equivalent circuit 200 of the spark plug 100B, and is generally the same as FIG. 2(B).

In this spark plug 100B, the high dielectric constant coating layer 90, which is formed through application of $BaTiO_3$ which is a high dielectric constant material, is further provided on the outer surface of the glaze layer 11 of the insulator 10. The high dielectric constant coating layer 90 covers a region indicated by a broken line. Specifically, the high dielectric constant coating layer 90 covers a portion of the outer surface of the insulator 10, which portion includes the outer surface of the terminal-side tube portion 16 and extends to a wall surface 15*w* of the collar portion 15 which constitutes a wall surface of the fixation assisting portion 80.

As described above, even in the case where a coating layer of a high dielectric constant material is provided on the outer surface of the insulator 10 located between the metallic shell 40 and the second conductive portion CP2, the capacitance Cu of the third capacitor 215 can be increased. Accordingly, radio noise of the spark plug 100B can be reduced further.

Figure 5:
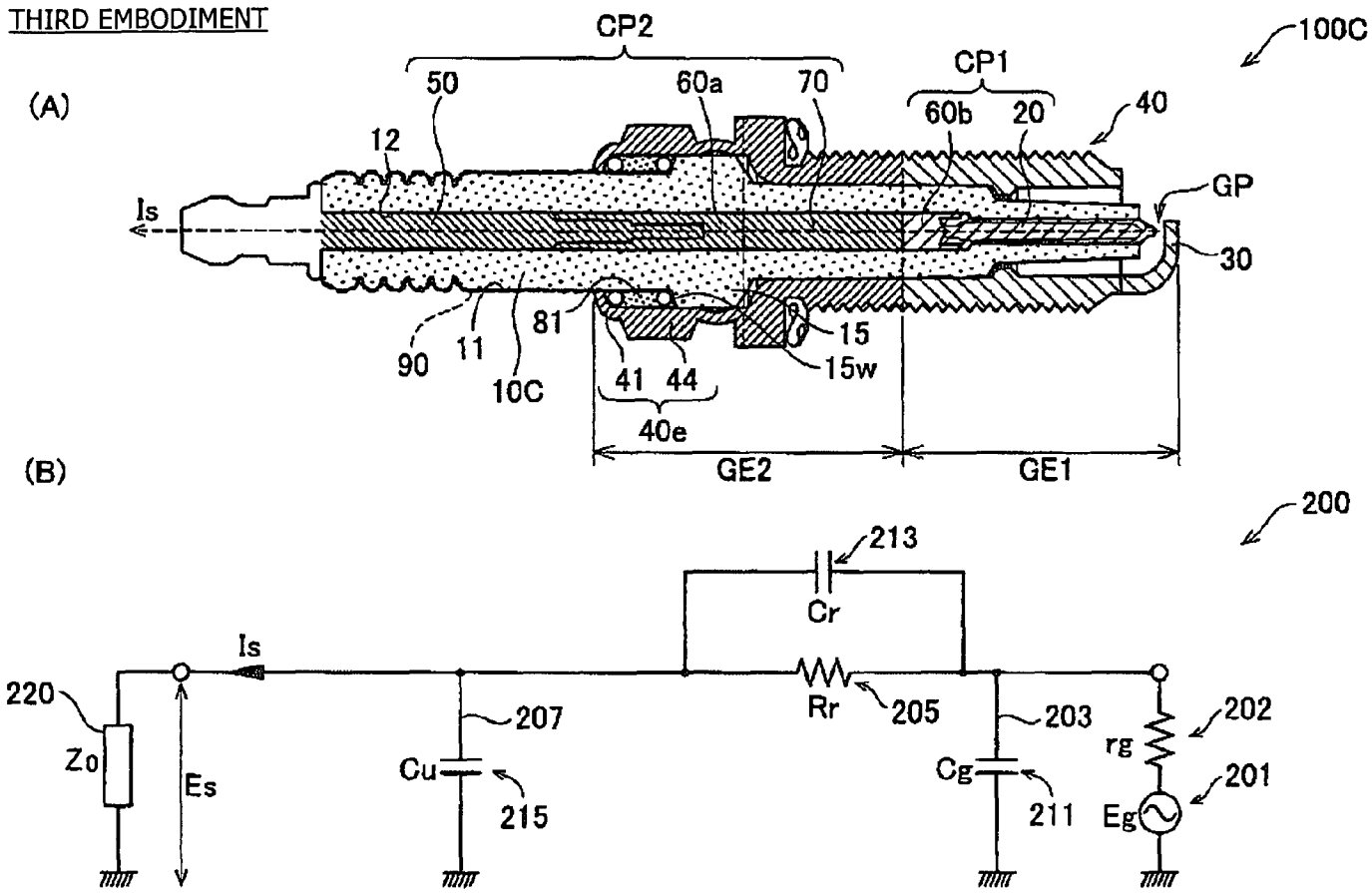
FIG. 5 is a schematic cross-sectional view of a spark plug according to a third embodiment, and circuit diagram showing its equivalent circuit.

C. Third Embodiment:

FIG. 5(A) is a schematic cross-sectional view showing the structure of a spark plug 100C according to a third embodiment of the present invention. FIG. 5(A) is generally the same as FIG. 4(A), except that a high dielectric constant insulator 10C is used in place of the insulator 10. FIG. 5(B) is a circuit diagram showing an equivalent circuit 200 of the spark plug 100C, and is generally the same as FIG. 4(B).

The high dielectric constant insulator 10C of this spark plug 100C is formed of $Al_2O_3$ into which $BaTiO_3$ is mixed as a high dielectric constant material. Preferably, $BaTiO_3$ having an average grain size of 5 μm or greater is used so as to suppress melting into glass at the time of firing.

As described above, even in the case where a material which is higher in dielectric constant than $Al_2O_3$ is mixed into the material of the insulator, the capacitance Cu of the third capacitor 215 can be increased. Accordingly, radio noise of the spark plug 100C can be reduced further.

D. Fourth Embodiment:

FIG. 6 is an explanatory table showing radio noise suppression effects of spark plugs according to a fourth embodiment of the present inventions. In this fourth embodiment, spark plugs of six types were assumed as Examples, and spark plugs of two types were assumed as Comparative Examples; and, for each spark plug, a predicted attenuation of radio noise was calculated through simulation. FIG. 6 is a table showing the results of the calculation. Specifically, this table shows the capacitances Cu, Cg, Cr of the first through third capacitors 211, 213, 215, and the resistance rg, Rr of the first and second resistors 202, 205 in each of the spark plugs of Comparative Examples and Examples.

Further, the table of FIG. 6 shows the calculated radio noise attenuation at a frequency of 500 MHz for each of the spark plugs of Comparative Examples and Examples, and the ratio (effect ratio) of the radio noise attenuation of each of Comparative Examples and Examples to that of each Comparative Example. Notably, the frequency of 500 MHz at which the attenuation was calculated was selected as a representative frequency of an intermediate frequency band and a high frequency band in which the effect of the present invention appears remarkably.

Moreover, the table of FIG. 6 shows the results of evaluation on the radio noise suppression effects of Comparative Examples and Examples performed on the basis of their effect ratios, in which the evaluation results are indicated by "Poor," "Good," and "Excellent." Specifically, when one of the effect ratio of a certain Example to Comparative Example 1 and the effect ratio of the certain Example to Comparative Example 2 was less than 1.1, the certain Example was evaluated as "Poor." When both the effect ratios of the certain Example were equal to or greater than 1.1 and one of the effect ratios of the certain Example was not greater than 1.3, the certain Example was evaluated as "Good." When both the effect ratios of the certain Example were equal to or greater than 1.3, the certain Example was evaluated as "Excellent."

The spark plug of Example 1 has a structure similar to that of the spark plug 100 of the first embodiment (FIG. 1), and includes the high dielectric constant fixation assisting member 81. The spark plug of Example 2 has a structure similar to that of the spark plug 100B of the second embodiment (FIG. 4), except that the spark plug of Example 2 includes talc instead of the high dielectric constant assisting member 81. The spark plug of Example 2 includes the high dielectric constant coating layer 90. The spark plug of Example 3 has a structure similar to that of the spark plug 100B of the second embodiment, and includes both the high dielectric constant fixation assisting member 81 and the high dielectric constant coating layer 90.

The spark plug of Example 4 includes the high dielectric constant fixation assisting member 81, as in the case of the spark plug of Example 1. The spark plug of Example 5 does not include the high dielectric constant fixation assisting member 81, but includes the high dielectric constant coating layer 90, as in the case of the spark plug of Example 2. The spark plug of Example 6 includes both the high dielectric constant fixation assisting member 81 and the high dielectric constant coating layer 90, as in the case of the spark plug of Example 3.

Meanwhile, each of the spark plugs of Comparative Example 1 and Comparative Example 2 has a structure similar to those of conventional spark plugs; that is, each of the spark plugs of Comparative Example 1 and Comparative Example 2 includes talc instead of the high dielectric constant fixation assisting member 81 and does not include the high dielectric constant coating layer 90. However, the spark plug of Comparative Example 1 and the spark plug of Comparative Example 2 differ from each other in terms of the capacitances Cu, Cg, Cr and the resistances rg, Rr. Notably, the spark plug of Comparative Example 1 differs from the spark plugs of Example 1 to Example 3 only in the value of the capacitance Cu, and the remaining capacitances Cg, Cr and the resistances rg, Rr of the spark plug of Comparative Example 1 are the same as those of the spark plugs of Example 1 to Example 3. Further, the spark plug of Comparative Example 2 differs from the spark plugs of Example 4 to Example 6 only in the value of the capacitance Cu, and the remaining capacitances Cg, Cr and the resistances rg, Rr of the spark plug of Comparative Example 2 are the same as those of the spark plugs of Example 4 to Example 6.

Comparison between the evaluation results of Examples 1 and 2 and that of Example 3 reveals that a better evaluation result was attained in Example 3 whose capacitance Cu is large. Similarly, comparison between the evaluation results of Examples 4 and 5 and that of Example 6 reveals that a better evaluation result was attained in Example 6 whose capacitance Cu is large. The above indicates that the greater the capacitance Cu, the higher the radio noise suppression effect, which is preferred. More specifically, the lower limit of the capacitance Cu is preferably 16.0 pF or greater, more preferably 18.0 pF or greater. Also, the lower limit of the capacitance Cu is preferably 25.0 pF or greater, more preferably 29.0 pF or greater. Further, the lower limit of the capacitance Cu is preferably 30.0 pF or greater, more preferably 36.0 pF or greater. Notably, the upper limit of the capacitance Cu is preferably 58.0 pF or less, more preferably 40.0 pF or less.

Further, a spark plug including both the high dielectric constant assisting member 81 and the high dielectric constant coating layer 90 is preferred, because the capacitance Cu can be increased further. Notably, the spark plug may be configured such that another high dielectric constant material (e.g., the high dielectric constant insulator 10C of the third embodiment) is disposed between the second conductive portion CP2 and the metallic shell 40 so as to increase the capacitance Cu.

The capacitance Cu can be increased by using a material having a higher dielectric constant as the high dielectric constant material disposed between the second conductive portion CP2 and the metallic shell 40, such as the high dielectric constant fixation assisting member 81, or the high dielectric constant coating layer 90. Further, the capacitance Cu can be increased by changing the structures of the second conductive portion CP2 and the metallic shell 40. Specifically, the capacitance Cu can be increased by increasing the surface areas of the second conductive portion CP2 and the metallic shell 40, or by decreasing the distance between the second conductive portion CP2 and the metallic shell 40. Moreover, the capacitance Cu can be increased by increasing the ratio of occupation of the high dielectric constant material within the space between the second conductive portion CP2 and the metallic shell 40. More specifically, the capacitance Cu can be increased by increasing the volume of the high dielectric constant fixation assisting member 81 or the thickness of the high dielectric constant coating layer 90.

As described above, according to the spark plugs of the fourth embodiment, radio noise of the spark plugs can be reduced further by increasing the value of the capacitance Cu.

E. Modifications:

Notably, the present invention is not limited to the above-described examples and embodiments, and may be practiced in various forms without departing from the scope of the invention. For example, the following modifications are possible.

E1. Modification 1:

In the above-described embodiments, the high dielectric constant fixation assisting member 81, the high dielectric constant coating layer 90, and/or the high dielectric constant insulator 10C is formed of a high dielectric constant material. However, the embodiments may be modified such that other portions are formed of a high dielectric constant material. No limitation is imposed on the position of the high dielectric constant material, so long as the high dielectric constant material is provided between the second conductive portion CP2 and the metallic shell 40. For example, the wire packings 82 and 83 may be formed of a high dielectric constant material. In this case, the high dielectric constant fixation assisting member 81 may be omitted. Further, the second embodiment may be modified such that the high dielectric constant fixation assisting member 81 is omitted, and only the high dielectric constant coating layer 90 is provided; and the third embodiment may be modified such that the high dielectric constant fixation assisting member 81 and/or the high dielectric constant coating layer 90 is omitted.

E2. Modification 2:

In the above-described embodiments, $BaTiO_3$ is employed as a high dielectric constant material; however, other high dielectric constant materials may be employed. Preferred high dielectric constant materials include ABO3-type perovskite oxides (The variable "A" is comprised of at least one of Ca, Sr, Ba, Pb, and La, and the variable "B" is comprised of at least one of Zr, Ti, Ce, and Al), zirconium (Zr) oxide, and hafnium (Hf) oxide.

E3. Modification 3:

In the above-described embodiments, the high dielectric constant fixation assisting member 81 is formed of a powder compact; however, the high dielectric constant fixation assisting member 81 is not necessarily required to be formed of a powder compact. However, in the case where the high dielectric constant fixation assisting member 81 is formed of a powder compact, the high dielectric constant fixation assisting member 81 can also function as a cushioning member in the spark plug 100 more effectively.

E4. Modification 4:

In the above-described second and third embodiments, on the outer surface of the insulator 10B, 10C, the glaze layer 11 is overlaid with the high dielectric constant coating layer 90. However, the second and third embodiments may be modified such that, in place of the glaze layer 11, a high dielectric constant glaze layer formed through application of a glaze into which a material whose dielectric constant is higher than that of $Al_2O_3$ is mixed is provided so as to increase the dielectric constant of the outer surface of the insulator.

Notably, the dielectric constant of the coating layer provided on the outer surface of the insulator can be determined by the following method. That is, the composition of the coating layer is determined by use of an electron probe microanalyzer (EPMA: Electron Probe Micro Analysis), and the dielectric constant is calculated from the composition. Notably, as this dielectric constant calculation method, the A. A. Appen method (reference: Chemistry of Glass (1974) published by Nisso Tsuushin Sha and written by A. A. Appen) can be used.

The invention claimed is:

1. A spark plug comprising:

a center electrode, a terminal portion electrically connected to the center electrode so as to apply a voltage from an external power source to the center electrode;

a ground electrode disposed on a front end side such that a gap for spark discharge is formed between the ground electrode and the center electrode;

a metallic shell which holds the ground electrode, which is electrically connected to the ground electrode, and in which the center electrode is disposed; and an insulator which is held within the metallic shell and in which the center electrode and the terminal portion are held, wherein the insulator is integrally formed and includes a collar portion which is located at an approximate center with respect to a longitudinal direction thereof and has an outer diameter greater than that of the remaining portion, and a tubular fixation assisting member is provided on the rear end side of the collar portion between said insulator and said metallic shell in order to assist a function of the metallic shell of holding the insulator; and the fixation assisting member includes at least a high dielectric constant material which is higher in dielectric constant than alumina.

2. A spark plug according to claim 1, wherein the high dielectric constant material is applied to an outer surface of the insulator as a coating layer.

3. A spark plug according to claim 1 or claim 2, wherein the high dielectric constant material contains an ABO3-type perovskite oxide, wherein "A" is at least one of Ca, Sr, Ba, Pb, and La; and "B" is at least one of Zr, Ti, Ce, and Al).

4. A spark plug according to claim 1 or claim 2, wherein the high dielectric constant material contains an oxide of zirconium (Zr) or hafnium (Hf).

5. A spark plug according to claim 1, wherein a capacitance between the terminal portion and the metallic shell is 16.0 pF or greater.

6. A spark plug according to claim 5, wherein the capacitance is 18.0 pF or greater.

7. A spark plug according to claim 5 or claim 6, wherein the capacitance is 29.0 pF or greater.

8. A spark plug according to claim 5 or claim 6, wherein the capacitance is 36.0 pF or greater.

9. A spark plug according to claim 5 or claim 6, wherein the capacitance is 58.0 pF or less.

10. A spark plug according to claim 5 or claim 6, wherein the capacitance is increased by a member which is disposed between the terminal portion and the metallic shell and which is higher in dielectric constant than alumina.

* * * * *